US006450660B1

(12) United States Patent
Lee

(10) Patent No.: US 6,450,660 B1
(45) Date of Patent: Sep. 17, 2002

(54) SPARE HALOGEN BULB HOLDER

(75) Inventor: Wade Lee, Danville, CA (US)

(73) Assignee: EML Technologies LLC, Danville, CA (US)

( * ) Notice: Subject to any disclaimer, the term of this patent is extended or adjusted under 35 U.S.C. 154(b) by 0 days.

(21) Appl. No.: 09/707,499

(22) Filed: Nov. 6, 2000

(51) Int. Cl.[7] ..... F21L 4/00

(52) U.S. Cl. ..... 362/207; 206/418

(58) Field of Search ..... 362/207; 206/418

(56) References Cited

U.S. PATENT DOCUMENTS 5,695,278 A 12/1997 Grossman et al. ..... 362/374
5,845,989 A 12/1998 Leen ..... 362/410

*Primary Examiner*—Sandra O'Shea
*Assistant Examiner*—Gui Young Lee
(74) *Attorney, Agent, or Firm*—Elliot B. Aronson

(57) ABSTRACT

A spare bulb holder arrangement for a quartz-halogen-type bulb used in a worklight that holds the bulb securely and safely against the rigors of use to which worklights can be subjected. The bulb holder is used with an elongate double-ended bulb of the sort that has an elongate envelope with end portions at each end of the envelope that are adapted for mounting the bulb in a worklight. The spare bulb holder includes an elongate bulb housing sized to receive a spare bulb, a spare bulb support structure sized to be received within the bulb housing, and a housing end cap for closing the bulb housing and for removing and inserting the spare bulb support structure. The support structure includes first and second bulb engaging members that are spaced apart from one another and that are disposed on the support structure to lie in registration with the end portions of the bulb. The bulb engaging members are formed to hold the bulb at its end portions and to enable a user to insert a bulb into and remove a bulb from the end portions. The end cap is connected to the support structure such that removing the end cap also removes the support structure. The bulb engaging members may be formed with two projecting prongs formed to hold a bulb end portion between the two prongs. The projecting prongs may be formed to engage the bulb end portion either at a flattened section or at the insulated contact piece used to make electrical contact. The bulb support structure may also include an elongate bulb carrier that carries the bulb engaging members in their proper spaced relationship.

10 Claims, 2 Drawing Sheets

SPARE HALOGEN BULB HOLDER

BACKGROUND OF THE INVENTION

The present invention relates to halogen worklights and is more particularly directed to arrangements for including a spare halogen bulb with a worklight.

Halogen worklights have become popular for use in such varied settings as construction jobs, industrial plants, automotive and auto body repair shops, artist and photographic studios, and projects around the home. Halogen bulbs have a comparatively high operating temperature and consequently a limited life, and it is not uncommon for them to burn out while in use on the job. When a bulb fails on the job, it interrupts the project at hand and usually has to be replaced before the work can continue. Thus, it is desirable to have a spare bulb handy.

At least two forms of spare bulb holders are known for a halogen bulb having a slender elongated profile such as commonly used in worklights that attach themselves to or form an integral part of the worklight, worklight stand or supporting structure. U.S. Pat. No. 5,695,278 of Grossman et al. shows a spare bulb storage compartment incorporated into a handle of the worklight that engages the spare bulb along its entire length in a supporting sleeve. U.S. Pat. No. 5,845,989 of Leen shows a worklight with an integral spare bulb container that uses a pair of end pieces that frictionally fit into a longitudinal spare bulb housing and which have longitudinal holes for receiving the ends of the elongate halogen bulb.

SUMMARY OF THE INVENTION

The present invention provides an alternative spare bulb holder arrangement for a quartz-halogen-type bulb that holds the bulb securely and safely against the rigors of use to which worklights can be subjected on the job and that nevertheless makes it easy to extract the bulb from the holder for use. The bulb holder is used with an elongate double-ended bulb of the sort that has an elongate envelope with end portions at each end of the envelope that are adapted for mounting the bulb and establishing electrical connections therewith. Briefly, a spare bulb holder in accord with the invention includes an elongate bulb housing sized to receive a spare bulb, a spare bulb support structure sized to be received within the bulb housing, and a housing end cap for closing the bulb housing and for removing and inserting the spare bulb support structure. The support structure includes first and second bulb engaging members spaced apart from one another and disposed on the support structure to lie in registration with the end portions of the bulb. The bulb engaging members are formed to hold the bulb at its end portions and to enable a user to insert a bulb into and remove a bulb from the end portions. The end cap is connected to the support structure such that removing the end cap also removes the support structure.

A spare bulb holder as described herein enjoys a number of benefits and advantages. A spare bulb is held securely and safely and so as to minimize excess or extraneous ware on the spare bulb while it is carried with the worklight. The spare bulb in the holder is able to withstand the rough handling and adverse conditions that may be met on the job on a par with the operating worklight bulb. The spare bulb holder may be embodied in a very simple construction making for simple and thus less costly fabrication, as well as simplicity and ease of use in inserting and withdrawing a bulb from the bulb holder.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 1:
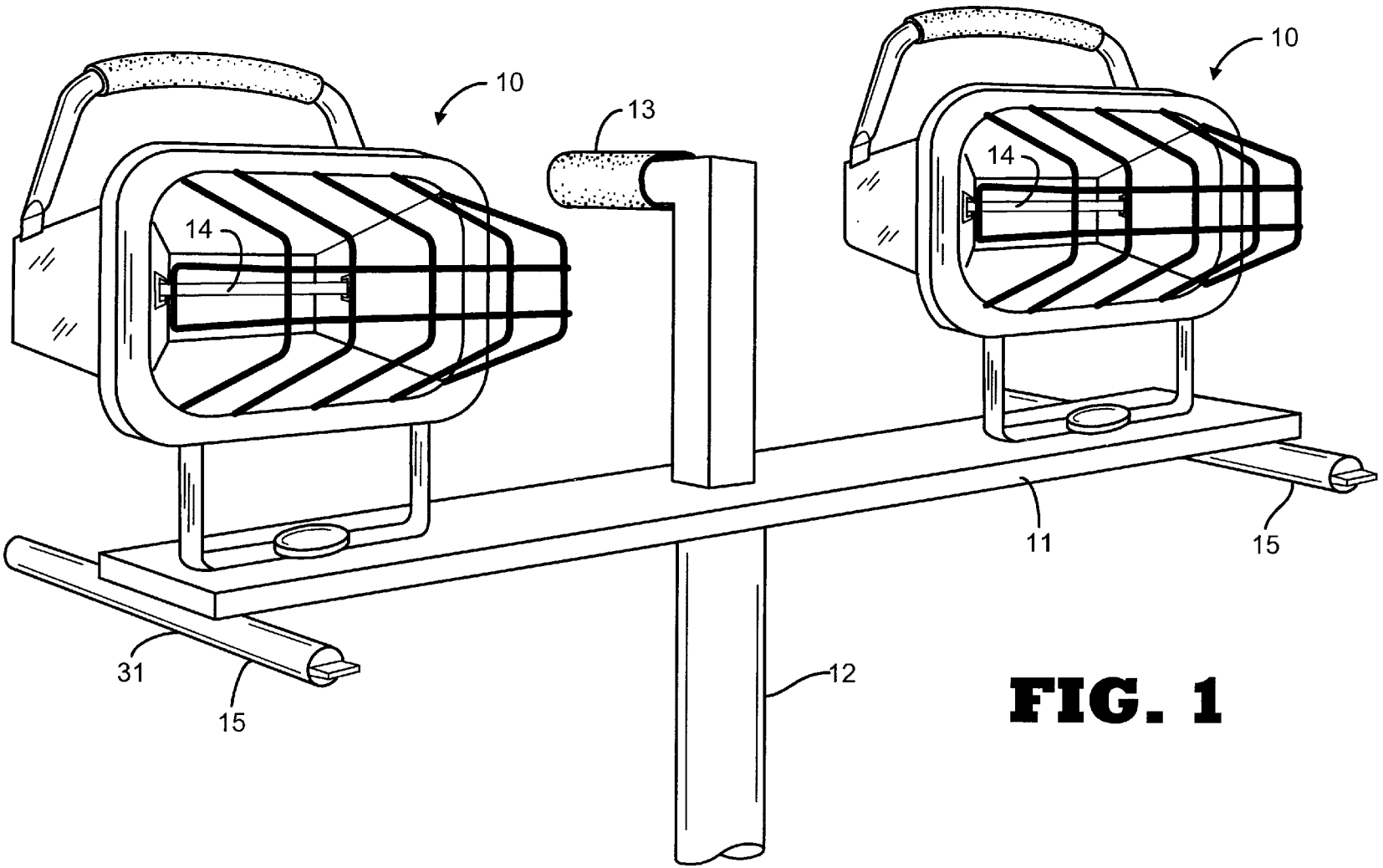
FIG. 1 is an overall perspective view of a pair of worklights mounted on a support bar with two spare bulb holders in accord with the invention.

FIG. 1 illustrates a spare bulb holder according to the invention in the example of a dual-head worklight fixture. In this configuration two worklight lamp heads 10 are mounted on a cross bar 11, which in turn is mounted on a tripod, the top portion of which may be seen at reference numeral 12. A carrying handle 13 is mounted on cross bar 11 for use in mounting the cross bar on the tripod or for otherwise carrying the cross bar with the dual heads mounted thereon. For clarity the electrical connections have been eliminated from FIG. 1 as they do not contribute to the elucidation of the present invention. An elongate quartz halogen bulb 14 is visible in each lamp head 10. Spare bulb holders 15 are shown mounted on the ends of cross bar 11.

Figure 2A:
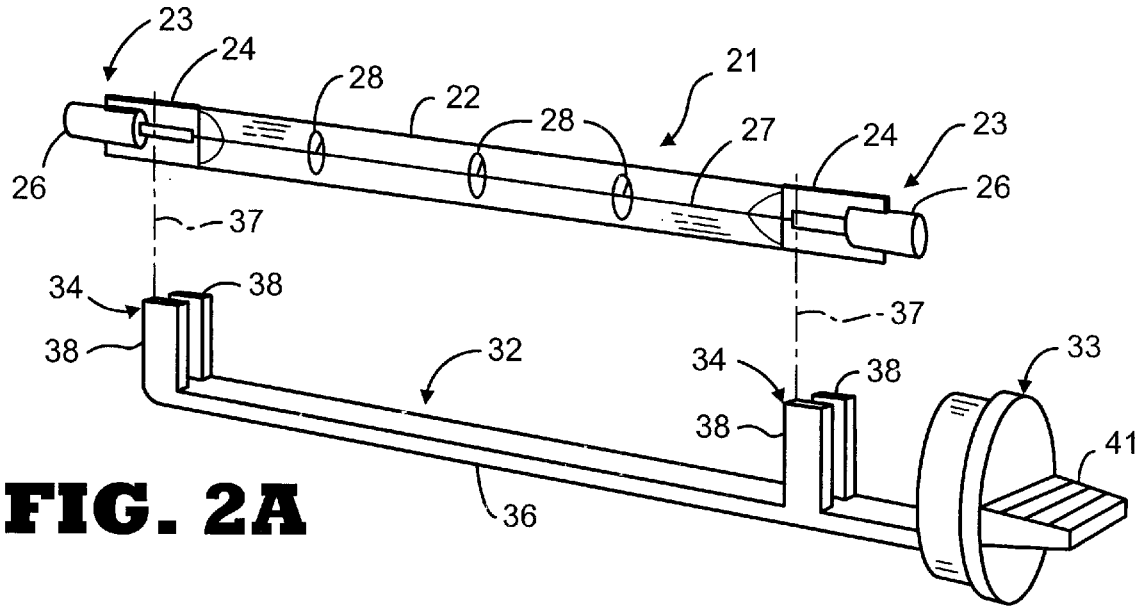
FIG. 2A is a perspective view showing a quartz halogen bulb and spare bulb support assembly.

The bulb holder of the present invention is intended to be used with a double-ended elongate quartz halogen bulb of the sort commonly used in worklights and other lighting fixtures. FIG. 2A shows an idealized representation of a quartz halogen bulb 21 including a transparent, generally tubular envelope 22 terminating in first and second end portions 23 adapted for mounting the bulb in a lighting fixture. In the embodiment shown here the envelope is crimped at each end to form a flattened bulb portion indicated generally at reference numeral 24, in which is embedded an insulated contact member 26 which includes an electrical contact. Insulated contact member 26 is typically formed of a ceramic insulator of generally cylindrical shape that has an electrically conducting contact (not shown) disposed along the central cylinder axis. A conducting filament 27 runs along the longitudinal axis of envelope 22 from end portion to end portion where it is connected to insulating contact members 26. Filament 27 is supported within the envelope by support rings 28.

The quartz halogen bulb is so called because envelope 22 is typically formed of a special quartz glass to withstand high operating temperatures and because the envelope is filled with a halogen gas which interacts in a beneficial way with a tungsten filament 27. For purposes of the invention, however, the quartz nature of the envelope and the halogen nature of the filling gas are not significant and the term double-ended elongate quartz halogen bulb is used merely to identify the shape of the bulb. Thus, the bulb holder disclosed herein may equally be used with other bulbs of the same general shape even if the envelope contains a non-halogen gas or is formed of something other than a quartz glass.

Figure 3:
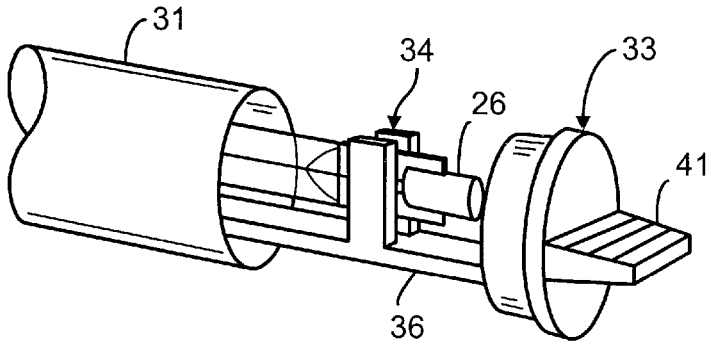
FIG. 3 is a perspective view of a quartz halogen bulb mounted in the spare bulb support assembly in position in a spare bulb housing.

A first embodiment of the spare bulb holder is described with reference to FIGS. 1, 2A and 3. The bulb holder includes an elongate spare bulb housing 31 sized to receive a bulb 21, a spare bulb support structure indicated generally at reference numeral 32 sized to be received within bulb housing 31, and a housing end cap 33 secured to support structure 32.

The elongate spare bulb housing 31 is of generally tubular shape and is sized to receive a spare bulb and its supporting structure. Tubular housing 31 has an open end, visible in FIG. 3, through which the spare bulb in its support structure is inserted and removed. The opposite end of housing 31 may be permanently sealed. The spare bulb housing will generally be affixed to an appropriate place so that the spare bulb will be conveniently available when the worklight fixture is in use. It may, for example, be affixed directly to or incorporated into the worklight housing itself or a handle or supporting structure for the worklight housing. It may be attached to a supporting frame or stand or tripod or clamping structure or other such structure that is attached to or operationally related to the worklight housing. It may even be secured in a carrying case for the worklight and associated apparatus. As used herein "worklight fixture" is understood generally to include the worklight head along with all its associated apparatus, including its handles, supporting frame, stand, tripod or associated clamping structure for holding the worklight when in use or other such structure that is attached to or used with the worklight head. The spare bulb holder will thus conveniently be attached to or be incorporated into the worklight fixture or a carrying case for the fixture.

Spare bulb support structure 32 has a length generally commensurate with the length of the bulb 21. The support structure includes first and second bulb engaging members 34, which in the embodiment of FIG. 2A are affixed to an elongate carrier 36. The bulb engaging members are spaced apart and disposed on carrier 36 to lie in registration with the corresponding end portions 23 of bulb 21. Bulb engaging members 34 are formed to hold the bulb at its end portions in such a manner that a user is able to remove the bulb from the bulb engaging members. By retaining the spare bulb at its end portions, the bulb is held in the spare bulb holder in the same general disposition as when the bulb is inserted for use in the worklight fixture itself.

Each bulb engaging member 34 is formed with two projecting prongs 38 which are carried by and project from carrier 36. In the embodiment of FIG. 2A the pairs of prongs are positioned opposite corresponding flattened portions 24 as indicated by the dashed lines 37 and are shaped to snugly engage and hold bulb 21 at the respective flattened portion 24. In particular, in FIG. 2A the prongs are formed with a generally flat face to engage and squeeze against the flattened portion of the bulb. To facilitate gripping and removal of the bulb, it is desirable that prongs 38 have a certain resiliency so that they will exhibit a sufficient give as a flattened bulb portion is urged between opposing prongs and as it is pulled from the grip of the prongs and yet return to their initial state after a bulb has been removed. ABS plastic has been found to provide sufficient resiliency and gripping power, but a proper resiliency can readily be determined empirically by the routine practitioner for other materials.

Figure 2B:
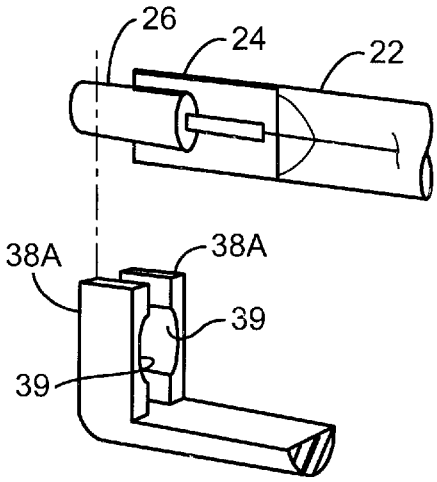
FIG. 2B is a close-up view of an alternative spare bulb retaining arrangement.

FIG. 2B shows an alternative embodiment, in which bulb engaging members 34 align with the generally cylindrical insulated contact members 26 instead of with the flattened portions 24 as in FIG. 2A. Here also the bulb engaging members comprise two projecting prongs 38A, the shape of which has been adapted to receive the cylindrical surface of a contact member 26. In particular, the inner surface of each prong 38A is formed with a longitudinal indentation 39 providing a detent holding the insulating contact members in position between opposing prongs.

End cap 33 is formed and arranged to close the open end of bulb housing 31. Support structure 32 is secured to end cap 33 in such a manner that removing the end cap also removes the support structure. In the simple construction illustrated herein carrier 36 is fixedly secured directly to end cap 33. In addition, the end cap is held by friction in the end of tubular housing 31. Other well known securement methods may also be used for retaining the end cap in the bulb housing, such as screw attachments, friction ribbing or bayonet attachments and mechanical equivalents. In the field the user removes the spare bulb holder from the housing or inserts it into the housing merely by removing the single end cap 33 from the housing or inserting it into the housing. End cap 33 is provided with a grip member 41 to assist the user in removing or inserting the cap.

The above descriptions and drawings disclose illustrative embodiments of the invention. Given the benefit of this disclosure, those skilled in the art will appreciate that various modifications, alternate constructions, and equivalents may also be employed to achieve the advantages of the invention. For example, although the bulb holder is illustrated in a dual-head tripod-mounted worklight, it is clear that the bulb holder may also be used in connection with other multiple-head or single-head worklight configurations as well so that no limitation to the particular worklight illustrated here or the particular mounting position is intended. Moreover, in the examples shown in the figures the bulb is held by bulb engaging members through the action of friction, including in the embodiment of FIG. 2B the action of the frictional detents. This is achieved with a very simple design for the bulb engaging members that has the advantages of ease of use and simplicity of fabrication. Other mechanisms, such as spring-assisted gripping mechanisms or mechanical latching mechanisms, may also be used for retaining a bulb in the bulb engaging members. Such alternative constructions are more complicated and thus will generally result in more complicated or more costly fabrication and possibly compromise the ease of use, but though less desirable for these reasons, such alternative constructions will nevertheless enjoy benefits and advantages of the invention and are intended to fall within the scope of the invention. Thus, the invention is not to be limited to the above specific descriptions and illustrations, but is defined by the appended claims.

What is claimed is:

1. A spare bulb holder for use with a worklight fixture utilizing at least one double-ended elongate bulb, said bulb comprising an elongate envelope and first and second end portions at first and second ends of said envelope for mounting said bulb in a worklight and for establishing electrical contact therewith, said spare bulb holder comprising:

an elongate spare bulb housing sized to receive a said bulb, said housing having an open end for inserting and removing a spare bulb therefrom;

a spare bulb support structure sized to be received in said spare bulb housing and comprising:

first and second bulb engaging members spaced apart from each other and disposed in said support structure to lie in registration with said first and second end portions of said bulb, said bulb engaging members being formed to hold said bulb at said end portions and to enable a user to insert said bulb end portions into said bulb engaging members and to remove said bulb end portions from said bulb engaging members; and an end cap secured to said spare bulb support structure and formed to close said open end of said housing, whereby said spare bulb is held securely in said bulb housing at said end portions and is removed from said bulb housing by removing said end cap.

2. The apparatus of claim 1 wherein said end portions of said bulb each include a flattened portion and said bulb engaging members each comprise first and second prongs formed for snugly engaging said bulb end portions at said flattened portion.

3. The apparatus of claim 1 wherein said end portions of said bulb each include an insulated contact member having an electrical contact therein and said bulb engaging members each comprise first and second prongs formed for snugly engaging a said bulb end portion at said insulated contact member.

4. The apparatus of claim 3 wherein said insulated electrical contact member is of generally cylindrical shape and said and said first and second prongs are formed to define a detent for snugly receiving a said bulb end portion at said generally cylindrical shape.

5. The apparatus of claim 1 wherein said spare bulb support structure further comprises an elongate carrier and said first and second bulb engaging members are affixed to said carrier.

6. The apparatus of claim 5 wherein said carrier is affixed directly to said end cap.

7. The apparatus of claim 6 wherein said end portions of said bulb each include a flattened portion and said bulb engaging members each comprise first and second prongs extending from said carrier and formed for snugly engaging a said bulb end portion at said flattened portion.

8. The apparatus of claim 6 wherein said end portions of said bulb each include an insulated contact member having an electrical contact therein and said bulb engaging members each comprise first and second prongs extending from said carrier and formed for snugly engaging a said bulb end portion at said insulated electrical contact member.

9. The apparatus of claim 8 wherein said insulated electrical contact member is of generally cylindrical shape and said and said first and second prongs are formed to define a detent for snugly receiving a said bulb end portion at said generally cylindrical shape.

10. The apparatus of claim 1 wherein said spare bulb housing is affixed to said worklight fixture.

* * * * *